US008287615B2

(12) United States Patent
Sato et al.

(10) Patent No.: US 8,287,615 B2
(45) Date of Patent: Oct. 16, 2012

(54) HIGH-STRENGTH COMPOSITION IRON POWDER AND SINTERED PART MADE THEREFROM

(75) Inventors: Masaaki Sato, Takasago (JP); Satoshi Furuta, Takasago (JP); Takahiro Kudo, Kobe (JP); Takehiro Tsuchida, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 569 days.

(21) Appl. No.: 12/573,275

(22) Filed: Oct. 5, 2009

(65) Prior Publication Data

US 2010/0116088 A1 May 13, 2010

(30) Foreign Application Priority Data

Nov. 10, 2008 (JP) ..... 2008-287856

(51) Int. Cl.
*B22F 1/00* (2006.01)
*C22C 33/02* (2006.01)

(52) U.S. Cl. ..... 75/252; 75/243; 75/246

(58) Field of Classification Search ..... 75/243, 75/246, 252

See application file for complete search history.

(56) References Cited

U.S. PATENT DOCUMENTS 5,703,304 A * 12/1997 Lindberg et al. ..... 75/243
5,997,805 A 12/1999 Lawcock et al.
6,143,240 A * 11/2000 Jones et al. ..... 419/25
8,038,761 B2 * 10/2011 Tanino et al. ..... 75/246
2009/0064819 A1 * 3/2009 Ando et al. ..... 75/246

FOREIGN PATENT DOCUMENTS

CN 1166802 A 12/1997
JP 2007-23318 2/2007
JP 2008-13818 1/2008

OTHER PUBLICATIONS

Chinese Office Action issued Apr. 20, 2012, in Patent Application No. 200910211512.1 (with Partial English-language translation).
"Principle of Powder Metallurgy", second version, Nov. 1997, pp. 267-272 (with Partial English translation).
Office Action issued Jul. 22, 2011 in China Application No. 200910211512.1 (With English Translation).

* cited by examiner

*Primary Examiner* — Roy King
*Assistant Examiner* — Ngoclan T Mai
(74) *Attorney, Agent, or Firm* — Oblon, Spivak, McClelland, Maier & Neustadt, L.L.P.

(57) ABSTRACT

A high-strength composition iron powder is prepared by mixing an iron base powder with 0.5 to 3.0 mass % of an Fe—Mn powder having a particle diameter of 45 μm or less and a Mn content in the range of 60 to 90 mass %, 1.0 to 3.0 mass % of a Cu powder, 0.3 to 1.0 mass % of a graphite powder, and 0.4 to 1.2 mass % of a powder lubricant for die-forming while adjusting the ratio of the amount of Mn contained in the Fe—Mn powder to the amount of the Cu powder in the range of 0.1 to 1. The high-strength composition iron powder is press-formed and sintered at a temperature equal to or higher than the melting point of Cu to produce a high-strength sintered part having a tensile strength of 580 MPa or higher without using expensive alloying elements such as Ni and Mo.

6 Claims, 2 Drawing Sheets

HIGH-STRENGTH COMPOSITION IRON POWDER AND SINTERED PART MADE THEREFROM

BACKGROUND OF THE INVENTION

1. Field of the Invention

The present invention relates to an inexpensive high-strength composition iron powder used as a raw material powder of a sintered part, and a sintered part made from the high-strength composition iron powder.

2. Description of the Related Art

Sintered parts obtained by press-forming metal powders into green compacts and sintering the green compacts are used as automobile parts such as synchronizer hubs and vane pump rotors, for example. Since automobile parts are required to achieve weight reduction to lower the fuel consumption, they are also required to achieve a higher strength. To satisfy such a requirement, alloyed steel powders containing Ni and Mo as the reinforcing elements are usually used as the metal powders.

One example of such an alloyed steel powder is an iron-based 0.6% carbon, 0.5% molybdenum alloyed powder (carbon-molybdenum material) prepared by blending an iron powder, a lubricant, ferromolybdenum, and graphite disclosed in U.S. Pat. No. 5,997,805. The '805 document teaches that when this carbon molybdenum alloyed powder is compacted into test rings under a compacting pressure of about $6.1\times10^8$ Pa, heated to sinter, and then subjected to high-density secondary forming operation at a pressure of $6.1\times10^8$ Pa, a density greater than 7.5 g/cm$^3$ is achieved, which shows clear improvements in dynamic properties from that achieved by the conventional process.

Japanese Unexamined Patent Application Publication No. 2007-23318 discloses alloyed steel powders, namely, mixed powders prepared by mixing a pure iron powder with a pre-alloyed steel powder containing 0.5% Ni, 0.5% Mo, and 0.2% Mn serving as alloy components at a variety of mixing ratios, and adding a graphite powder and a Cu powder to the resulting mixture. The mixed powders are press-formed into round bar-shaped test pieces under a pressure of 6 ton/cm$^2$. The test pieces are sintered, hot-forged, and evaluated in terms of strength properties such as tensile strength and self-aligning properties during assembly of the sintered parts, the results of which are disclosed in the '318 document.

However, recent price surge of alloying elements, in particular, Ni and Mo, has let to an increase in manufacture cost of sintered parts produced by using starting material powders containing Ni and Mo. Thus, an inexpensive high-strength steel powder that contains alloying elements that replace Ni and Mo is desired.

SUMMARY OF THE INVENTION

An object of the present invention is to provide a raw material powder that can be press-formed and sintered to make sintered parts, the raw material powder containing inexpensive alloying elements that replace expensive elements such as Ni and Mo a, and to provide a sintered part made from the raw material powder.

To achieve the object, the present invention provides the following.

The iron powder of the present invention contains an iron base powder, 0.5 to 3.0 mass % of an Fe—Mn powder having a particle diameter of 45 μm or less and a Mn content in the range of 60 to 90 mass %, 1.0 to 3.0 mass % of a Cu powder, and 0.3 to 1.0 mass % of a graphite powder. The mass ratio of the amount of Mn contained in the Fe—Mn powder to the amount of the Cu powder is in the range of 0.1 to 1.

In general, Ni, Mo, Mn, Cu, graphite, and the like are added as reinforcing elements to enhance the strength of sintered parts. According to the present invention, inexpensive Fe—Mn, Cu, and graphite are used as the reinforcing elements instead of expensive Ni and Mo, and these elements are added and mixed at a particular ratio as described above to provide high-strength sintered parts at low cost. Manganese is added in the form of Fe—Mn since oxidation of Mn by heat-treatment conducted as needed during and after sintering can be reduced compared to when Mn is added in elemental form. The reason for adding Mn at the same time with a particular amount of Cu powder is as follows. That is, when sintering is conducted at a temperature not less than the melting temperature (melting point) of Cu, Cu melts during sintering and diffuses into Fe—Mn, thereby giving a Cu—Mn alloy. Cu—Mn has a melting point lower than that of elemental Mn, and manganese diffuses into the composition iron powder faster, thereby enhancing the strength of the sintered part. In addition, generation of the Cu—Mn alloy prevents oxidation of Mn in a heat-treatment atmosphere during or after sintering compared to when Mn is in the elemental form, and can prevent the decrease in strength caused by oxidation of Mn. However, when the mass ratio of the amount of Mn in the Fe—Mn powder to the amount of the Cu powder is less than 0.1, the reinforcing effect is insufficient. When this ratio exceeds 1, the amount of Cu—Mn alloy generated is not equivalent to the amount of Mn, and the amount of oxidized excess Mn increases, thereby decreasing the strength.

The Fe—Mn powder content is set in the range of 0.5 to 3.0 mass % for the following reasons. At an Fe—Mn content less than 0.5 mass %, the reinforcing effect is insufficient. At an Fe—Mn content exceeding 3.0 mass %, the density of the sintered part decreases significantly due to addition of the Fe—Mn powder, resulting in failure to enhance the strength, and notable size expansion occurs on sintering, resulting in failure to maintain dimensional accuracy of the product.

When the particle diameter of the Fe—Mn powder exceeds 45 μm, diffusion of Mn into the composition iron powder becomes insufficient and the strength cannot be sufficiently enhanced. The particle diameter of the Fe—Mn powder is preferably 30 μm or less and more preferably 10 μm or less.

The Mn content in the Fe—Mn powder is set within the range of 60 to 90 mass % for the following reasons. At a Mn content less than 60 mass %, the amount of the Fe—Mn powder needed to achieve the required amount of Mn increases, and this increases the hardness of the raw material powder and decreases the density of the press-formed compact and the strength of the compact on sintering. At a Mn content exceeding 90 mass %, the Mn content in the Fe—Mn powder is excessively large, and this increases the amount of manganese oxidized during sintering, decreases the amount of Mn contributing to strength enhancement, and lowers the strength since the oxidized manganese diffuses into crystal grain boundaries.

The Cu powder content is set within the range of 1.0 to 3.0 mass % for the following reasons. At a Cu powder content less than 1%, the increase in strength caused by solution hardening is little and the amount of Cu—Mn alloy equivalent to the amount of manganese is not generated during sintering. Thus, the reinforcing effect caused by faster diffusion of Mn into the composition iron powder and the effect of preventing oxidation of Mn by generation of Cu—Mn are reduced. At a Cu powder content exceeding 3.0 mass %, significant size expansion occurs as with the case of Fe—Mn described above, and the dimensional accuracy of the product can no longer be maintained.

In order to increase the compaction density, a pure Cu powder having a purity of 99% or higher is preferably used as the Cu powder. The average particle diameter of the Cu powder is 150 μm or less and more preferably 100 μm or less since the number of particles forming pores when melted during sintering increases if the average diameter is excessively large and this leads to a decrease in strength.

Graphite is a native element essential for increasing the strength of the sintered part. The graphite powder content is set within the range of 0.3 to 1.0 mass % since at a graphite content less than 0.3 mass %, the reinforcing effect is little and at a graphite content exceeding 1.0 mass %, cementite precipitates and decreases the strength. The particle diameter of the graphite powder is preferably within the range of 1 to 20 μm since the cost rises when the particle diameter is excessively small and diffusion becomes difficult when the particle diameter is excessively large. More preferably, the diameter is within the range of 2 to 15 μm.

It should be noted here that the Fe—Mn powder content, the Cu powder content, and the graphite powder content described here are each a ratio relative to the total mass of the three powders and the iron base powder.

The iron powder of the present invention may further contain 0.4 to 1.2 mass % of a powder lubricant for die-forming.

When the powder lubricant for die-forming is added in advance, there is no need to apply a lubricant for releasing the product from a forming die during press-forming of the composition iron powder and the workability is improved. An effect of improving the density of a compact caused by reduction of friction between the powder particles or between the powder particles and the walls of the forming die can also be achieved. Examples of the powder lubricant for die-forming include metal salts of stearic acid such as zinc stearate, lithium stearate, and calcium stearate. The lubricant content is 0.4 to 1.2 mass % since at a lubricant content less than 0.4 mass %, the friction-reducing effect is insufficient, and at a lubricant content exceeding 1.2 mass %, the friction-reducing effect shows no significant improvement while the density of the compact is adversely affected. The particle size of the powder lubricant for die-forming is preferably in the range of 5 to 50 μm. The content of the powder lubricant for die-forming described above is a ratio relative to the total mass of the high-strength composition iron powder containing the Fe—Mn powder, the Cu powder, the graphite powder, and the iron base powder described above.

In the iron powder of the present invention, the iron base powder is preferably a pure iron-type iron powder having a purity of 98% or higher. The pure iron-type iron powder more preferably has a purity of 99% or higher. As for the incidental impurities, C: 0.05% or less, Si: 0.05% or less, P: 0.05% or less, S: 0.05% or less, Ni: 0.05% or less, Cr: 0.05% or less, Mo: 0.05% or less, and O: 0.25% or less are more preferred. In general, when the Mn content in the iron base powder is high, the compressibility during press-forming decreases, and the amount of manganese oxidized during sintering increases since manganese is easily oxidizable. Because manganese oxide has an oxidizing effect, the respective components in the high-strength composition iron powder are adversely affected. In order to suppress the adverse effect, the Mn content in the pure iron-type iron powder is preferably 0.3 mass % or less. The average particle diameter of the pure iron-type iron powder is preferably 50 to 100 μm. At an average diameter less than 50 μm, the density does not easily increase upon press-forming and there is a tendency that a greater number of pores are formed. More preferably, the average particle diameter is 60 μm or more. When the average particle diameter exceeds 100 μm, sinterability is degraded and large pores tend to occur in the surface of a sintered part and decrease the strength.

In the iron powder of the present invention, the iron base powder may contain at least one alloying element selected from the group consisting of Ni, Mo, Cr, and Mn and the total content of the at least one alloying element is in the range of 0.3 to 2.0 mass %.

When the iron base powder is an alloyed powder containing the alloying elements as described above, a strength comparable or superior to that achieved by a 4Ni-1.5Cu-0.5Mo diffusion-alloyed steel powder widely used as a high-strength material that has good compressibility can be achieved while reducing the amounts of expensive Ni and Mo. When the total content is less than 0.3 mass %, the reinforcing effect is smaller than when a pure iron-type iron powder is used as the iron base powder. The required strength-enhancement is achieved up to a total content of 2.0 mass %, and at a total content exceeding 2.0 mass %, the iron base powder becomes hard and the density does not easily increase during forming, resulting in a lower strength. In particular, when the alloy content exceeds 2 mass %, the density significantly decreases upon forming. Moreover, since the iron base powder is hard, the lifetime of the forming die is shortened, and the cost rises thereby.

To the iron powder of the present invention, 0.1 to 0.8 mass % of a machinability-improving powder may be further added.

In general, a sintered part formed by sintering a green compact is used. However, in the case where the sintered product does not have required dimensional accuracy as is or where high dimensional accuracy is required for the parts, machining is performed. Examples of the machinability-improving powder that can be used include sulfide powders such as MnS and MgS, Ca compound powders such as CaF, and complex sulfide powders containing Mn and Mg. When the machinability-improving powder content is less than 0.1 mass %, the effect of improving the machinability is small. According to the composition ranges of the high-strength composition iron powder, excessive addition of the machinability-improving powder in an amount exceeding 0.8 mass % decreases the compressibility during press-forming. Moreover, since the machinability-improving powder has an apparent density smaller than that of the iron base powder, the occupancy ratio of iron decreases and the material properties such as tensile fatigue strength and toughness are degraded. A machinability-improving powder having an average particle diameter in the range of 1 to 20 μm is preferably added. At an average particle diameter less than 1 μm, the machinability-improving effect is degraded. At an average particle diameter exceeding 20 μm, coarse machinability-improving powder is found in the sintered part, and when a stress is applied during operation of the sintered part, the stress concentration occurs in the vicinity of the machinability-improving powder, readily resulting in cracking defects and the like.

Another aspect of the present invention provides a high-strength sintered part produced by press-forming the iron powder and sintering the press-formed iron powder. The sintering is performed in the temperature range of the melting point of Cu to 1300° C.

Sintering is performed at the melting point of Cu (melting temperature) or higher for the following reason. That is, as described above, when the iron powder is sintered at the melting point of Cu (melting temperature) or higher, Cu melts during sintering and diffuses into Fe—Mn, thereby giving a Cu—Mn alloy. Cu—Mn has a melting point lower than that of elemental Mn and increases the speed of Mn diffusing into the composition iron powder, thereby improving the strength of the sintered part. Moreover, when a Cu—Mn alloy is formed, oxidation of Mn in the heat treatment atmosphere during and on sintering is prevented to a greater extent than when Mn is present in an elemental form. When sintering is performed at a high temperature exceeding 1300° C., the dimensional accuracy and the shape retention are degraded due to shrinkage on sintering and the energy consumption increases. Sintering is more preferably performed at 1250° C. or less.

In this invention, inexpensive Fe—Mn, Cu, and graphite are used as alloying elements instead of expensive Ni and Mo, powders of these elements are added to and mixed with a pure iron-type iron base powder at a particular ratio, and the Mn content in the Fe—Mn powder on a mass basis and the mass ratio of the amount of Mn to the amount of Cu powder are defined. Thus, an inexpensive raw iron powder that can form a high-strength sintered part can be provided. Even when the iron base powder is an alloyed iron powder containing Ni and/or Mo, the amounts of expensive Ni and Mo to be added can be reduced while still achieving a comparable or superior strength.

Since a powder lubricant for die-forming is added to the high-strength composition iron powder, there is no need to apply a lubricant on a die in press-forming the composition iron powder and the workability is improved. Since a machinability-improving powder is added to the high-strength composition iron powder, improved machinability required for the sintered part to achieve high dimensional accuracy can be obtained. Since the high-strength composition iron powder is sintered at a temperature equal to or more than the melting point of Cu, Cu melts during sintering and a Cu—Mn alloy having a melting point lower than elemental Mn is generated. As a result, Mn diffuses into the iron base powder faster, oxidation of Mn is prevented, and a sintered part with improved strength can be obtained.

DESCRIPTION OF THE PREFERRED EMBODIMENTS

The preferred embodiments of the present invention will now be described by referring to Examples.

An iron base powder contained in the high-strength composition iron powder is a pure iron-type iron powder produced by a known iron powder manufacturing method such as an atomizing method (spraying method). The Mn content in the pure iron-type iron powder is limited to 0.3 mass % or less. An Fe—Mn powder is produced by a method similar to producing the iron base powder, e.g., an atomizing method, from a molten Fe—Mn alloy. The particle size of the Fe—Mn powder is adjusted to 45 μm or less by classification. A Cu powder is produced by an atomizing method or an electrolytic method, and the particle size is preferably adjusted to 300 μm or less by classification. A graphite powder may be a powder of natural or synthetic graphite preferably having a particle size adjusted to 50 μm or less. To the iron base powder, 0.5 to 3.0 mass % of the Fe—Mn powder having a particle diameter adjusted to 45 μm or less, 1.0 to 3.0 mass % of the Cu powder, 0.3 to 1.0 mass % of the graphite powder, and 0.4 to 1.2 mass % of a zinc stearate powder having a particle diameter of about 10 μm and serving as a powder lubricant for die-forming are added so that the mass ratio of the amount of Mn in the Fe—Mn powder to the amount of Cu powder is in the range of 0.1 to 1. The resulting mixture is mixed with, for example, a V-type mixer into a homogeneous mixture. As a result, a high-strength composition iron powder is produced. Instead of adding the powder lubricant for die-forming, a lubricant can be directly applied on a die in press-forming the high-strength composition iron powder. Alternatively, a lubricating method may be employed in which direct lubrication of the die is performed while reducing the amount of the powder lubricant for die-forming to less than 0.4 mass %.

EXAMPLES

To a pure iron-type iron powder having a composition shown in Table 1, 0.4 mass % to 4.0 mass % of an Fe—Mn powder (Nos. 1 to 28: 22% Fe-78% Mn, No. 29: 5% Fe-95% Mn, No. 30: 50% Fe-50% Mn) having a particle size in the range of 5 μm to 100 μm, 0.5 mass % to 4.0 mass % of a Cu powder having a D50 (average particle diameter) of 75 μm, 0.2 mass % to 1.2 mass % of a graphite powder having a D50 (average particle diameter) of 15 μm, and 0.8 mass % of zinc stearate serving as a powder lubricant for powder metallurgy were added. The resulting iron powders respectively having compositions shown in Table 2 were homogeneously mixed for 30 minutes in a V-type mixer to prepare respective composition iron powders. Note that the Fe—Mn powder had been pulverized with a vibratory balls to adjust the particle diameter.

Figure 1:
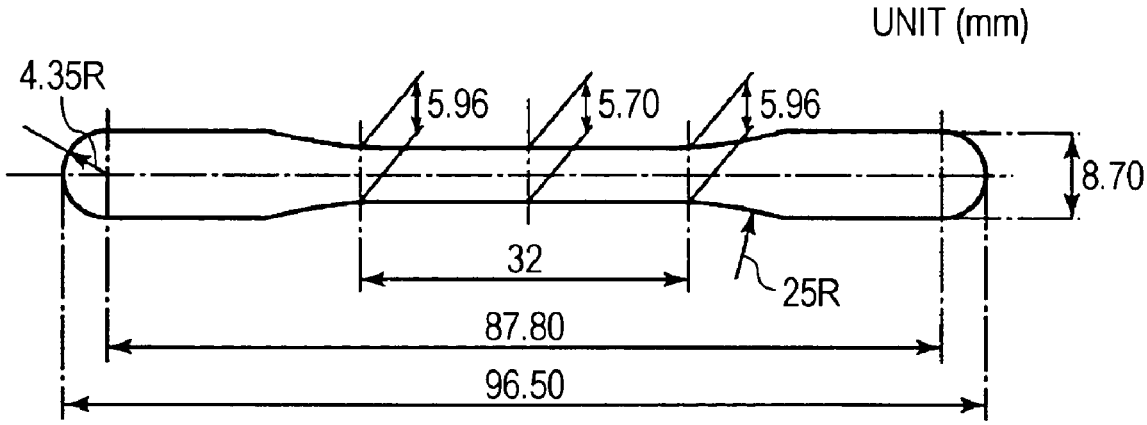
FIG. 1 is a diagram showing the shape of a tensile test piece used in Examples.

Each of the homogeneously mixed composition iron powders was compressed at a compressing pressure of 5 ton/cm$^2$ (490 MPa) into a dog bone-shaped tensile test piece with a thickness of 6 mm according to American Metal Powder Industries Federation (MPIF) standard as shown in FIG. 1. Each tensile test piece was sintered at 1120° C. in a nitrogen atmosphere for 20 minutes. Using the sintered tensile test piece as a sample, tensile testing was performed with a universal tester. The tensile strength of each composition iron powder is shown in Table 2.

In addition to the pure iron-type iron powder shown in Table 1, prealloyed-type steel powders containing a total of 3.5 mass % or less of Ni and Mo were also used as the iron base powder, and tensile test pieces shown in FIG. 1 were also formed by compression under the same conditions as the pure iron-type iron powders shown in Table 1 and sintered under the same condition. The observed tensile strengths are shown in Table 2. Under the same conditions as the composition iron powders shown in Table 2, tensile test pieces shown in FIG. 1 were prepared from a 4% Ni-1.5% Cu-0.5% Mo diffusion-alloyed steel powder that is widely used for its good compressibility and prepared by, as shown in Table 3, adding Ni, Cu, and Mo to the pure iron-type iron powder shown in Table 1.

TABLE 1

| C | Si | Mn | P | S | N | O |
|---|---|---|---|---|---|---|
| 0.002 | 0.01 | 0.18 | 0.004 | 0.005 | 0.002 | 0.13 |

TABLE 2

| No. | Iron base powder | Fe—Mn powder Particle diameter (μm) | Content (mass %) | Cu Content (mass %) | Graphite Content (mass %) | Content Ratio Mn/Cu | Tensile strength (MPa) | Reference |
|---|---|---|---|---|---|---|---|---|
| 1 | Pure iron-type iron powder | 45 | 1.3 | 2.0 | 0.8 | 0.51 | 610 | Example |
| 2 | Pure iron-type iron powder | 15 | 1.3 | 2.0 | 0.8 | 0.51 | 630 | Example |
| 3 | Pure iron-type iron powder | 5 | 1.3 | 2.0 | 0.8 | 0.51 | 650 | Example |
| 4 | Pure iron-type iron powder | 15 | 1.3 | 3.0 | 0.8 | 0.34 | 680 | Example |
| 5 | Pure iron-type iron powder | 15 | 1.3 | 1.0 | 0.8 | 1.0 | 580 | Example |
| 6 | Pure iron-type iron powder | 15 | 1.3 | 3.0 | 1.0 | 0.34 | 630 | Example |
| 7 | Pure iron-type iron powder | 15 | 0.8 | 3.0 | 0.8 | 0.21 | 620 | Example |
| 8 | Pure iron-type iron powder | 15 | 1.0 | 3.0 | 0.8 | 0.26 | 650 | Example |
| 9 | Pure iron-type iron powder | 15 | 2.0 | 3.0 | 0.8 | 0.52 | 630 | Example |
| 10 | Pure iron-type iron powder | 15 | 3.0 | 3.0 | 0.8 | 0.78 | 580 | Example |
| 11 | Pure iron-type iron powder | 15 | 1.3 | 3.0 | 0.6 | 0.34 | 660 | Example |
| 12 | Pure iron-type iron powder | 15 | 1.3 | 3.0 | 0.3 | 0.34 | 580 | Example |
| 13 | Pure iron-type iron powder | 15 | 0.5 | 3.0 | 0.8 | 0.13 | 600 | Example |
| 14 | 0.5% Ni—0.5% Mo | 15 | 1.3 | 3.0 | 0.8 | 0.34 | 710 | Example |
| 15 | 0.5% Mo | 15 | 1.3 | 3.0 | 0.8 | 0.34 | 690 | Example |
| 16 | 0.85% Mo | 15 | 1.3 | 3.0 | 0.8 | 0.34 | 700 | Example |
| 17 | Pure iron-type iron powder | 100 | 1.3 | 2.0 | 0.8 | 0.51 | 500 | Co. Ex. |
| 18 | Pure iron-type iron powder | 75 | 1.3 | 2.0 | 0.8 | 0.51 | 550 | Co. Ex. |
| 19 | Pure iron-type iron powder | 15 | 2.0 | 0.5 | 0.8 | 3.1 | 390 | Co. Ex. |
| 20 | Pure iron-type iron powder | 15 | 1.3 | 3.0 | 1.2 | 0.34 | 560 | Co. Ex. |
| 21 | Pure iron-type iron powder | 15 | 1.3 | 4.0 | 0.8 | 0.25 | 570 | Co. Ex. |
| 22 | Pure iron-type iron powder | 15 | 3.0 | 1.0 | 0.8 | 2.3 | 430 | Co. Ex. |
| 23 | Pure iron-type iron powder | 15 | 4.0 | 3.0 | 0.8 | 1.0 | 500 | Co. Ex. |
| 24 | Pure iron-type iron powder | 15 | 1.3 | 3.0 | 0.2 | 0.34 | 540 | Co. Ex. |
| 25 | Pure iron-type iron powder | 15 | 0.4 | 3.0 | 0.8 | 0.1 | 560 | Co. Ex. |
| 26 | Pure iron-type iron powder | 15 | 1.3 | 5.0 | 0.8 | 0.2 | 430 | Co. Ex. |
| 27 | Pure iron-type iron powder | 15 | 0.3 | 3.0 | 0.8 | 0.08 | 540 | Co. Ex. |
| 28 | Pure iron-type iron powder | 15 | 4.0 | 0.8 | 0.8 | 3.9 | 400 | Co. Ex. |
| 29 | Pure iron-type iron powder | 15 | 1.1 | 3.0 | 0.8 | 0.35 | 550 | Co. Ex. |
| 30 | Pure iron-type iron powder | 15 | 2.0 | 3.0 | 0.8 | 0.33 | 505 | Co. Ex. |
| 31 | 1.5% Mo | 15 | 1.3 | 3 | 0.8 | 0.34 | 720 | Example |
| 32 | 2% Ni—0.5% Mo | 15 | 1.3 | 3 | 0.8 | 0.34 | 650 | Co. Ex. |
| 33 | 3% Ni—0.5% Mo | 15 | 1.3 | 3 | 0.8 | 0.34 | 610 | Co. Ex. |

Co. Ex.: Comparative Example

TABLE 3

| C | Si | Mn | P | S | Ni | Cu | Mo | O |
|---|---|---|---|---|---|---|---|---|
| 0.002 | 0.01 | 0.18 | 0.007 | 0.007 | 4.05 | 1.55 | 0.55 | 0.13 |

The tensile strength for the 4% Ni-1.5% Cu-0.5% Mo diffusion-alloyed steel powder was 580 MPa. The strength of 580 MPa or more was set as the target strength of the composition iron powders shown in Table 2. Table 2 shows that all test pieces achieved the target strength of 580 MPa or higher when raw material powders respectively having compositions of Nos. 1 to 13 were used, namely, when a pure iron-type iron powder was used as the iron base powder, the Fe—Mn powder particle size (particle diameter) and content, the Cu powder content, and the graphite powder content were within the above-described ranges defined by the present invention, and the mass ratio of the amount of Mn in the Fe—Mn powder to the amount of the Cu powder was in the range of 0.1 to 1. This means that the composition iron powders of Nos. 1 to 13 within the ranges defined by the present invention can achieve a high strength comparable or superior to the 4% Ni-1.5% Cu-0.5% Mo diffusion-alloyed steel powder although they are free of expensive Ni or Mo.

In No. 14, a prealloyed-type steel powder prepared by adding 0.5 mass % of Ni and 0.5 mass % of Mo, i.e., a total of 1.0 mass % of Ni and Mo, to the pure iron-type iron powder shown Table 1 was used as the iron base powder. In Nos. 15 and 16, prealloyed-type steel powders prepared by respectively adding 0.5 mass % and 0.85 mass % of Mo to the pure iron-type iron powder were used as the iron base powder. In Nos. 14 to 16, a tensile strength notably higher than the target strength, 580 MPa was achieved by adding as little as 1 mass % of Ni and Mo in total, which is the amount of alloying element added to the iron base powder smaller than the alloying element content in 4% Ni-1.5% Cu-0.5% Mo. This proves that the iron powder composition of the present invention in which particular amounts of powders of Fe—Mn, Cu, and graphite less expensive than Ni and Mo are added to and mixed with an iron base powder and the mass ratio of the Mn content in the Fe—Mn powder and the mass ratio of the amount of Mn to the amount of the Cu powder added are defined can enhance the strength at a low cost compared to conventional diffusion-alloyed steel powders.

In Nos. 17 and 18, the particle diameters of the Fe—Mn powder were larger than 45 μm, i.e., 100 μm and 75 μm, respectively. Thus, Mn did not sufficiently diffuse into the composition iron powder and the tensile strengths were below the target strength, 580 MPa, i.e., 500 MPa and 550 MPa, respectively. In No. 19, the Cu powder content was low, i.e., 0.5 mass % and the ratio Mn/Cu of the amount of Mn in the Fe—Mn powder to the amount of Cu powder added was 3.1 which was outside the prescribed range (0.1 to 1). Thus, the tensile strength was 390 MPa, i.e., notably lower than the target strength, 580 MPa.

In No. 20, the graphite content was as high, i.e., 1.2 mass %, and thus network cementite occurred in the sintered structure. In No. 21, the Cu powder content was high, i.e., 4 mass %, and thus undiffused Cu was present in the composition iron powder. Due to a decrease in density caused by size expansion on sintering, the tensile strength was 560 MPa in No. 20 and 570 MPa in No. 21, i.e., lower than the target strength, 580 MPa. In No. 22, the mass ratio Mn/Cu was 2.3, i.e., outside the range of the present invention and thus the tensile strength was as low as 430 MPa. In No. 23, because the Fe—Mn powder content was high, i.e., 4 mass %, oxidation of Mn progressed and the tensile strength was low, i.e., 500 MPa.

In No. 24, the graphite content was low, i.e., 0.2 mass %, and thus the tensile strength was 540 MPa and did not reach the target strength 580 MPa. In No. 25, the Fe—Mn powder content was low, i.e., 0.4 mass %, and thus the tensile strength was 560 MPa and did not reach the target strength 580 MPa. In No. 26, the Cu powder content was 5 mass % and was larger than 4 mass % in No. 21. Thus, a larger amount of undiffused Cu was present in the composition iron powder, and the tensile strength decreased to 430 MPa since the density decreased more notably by size expansion on sintering. In No. 27, the Fe—Mn powder content was 0.3 mass % and was lower than 0.4 mass % in No. 22 and the mass ratio Mn/Cu was less than 0.1. Thus, the tensile strength was 540 MPa, which was lower than 560 MPa in No. 22.

In No. 28, the Fe—Mn powder content was high, i.e., 4 mass %, the Cu powder content was low, i.e., 0.8 mass %, and the mass ratio Mn/Cu was larger than the target range. Thus, the tensile strength was low, i.e., 400 MPa. In No. 29, the Mn content in the Fe—Mn powder was as high as 95%. Thus, the amount of Mn oxidized during sintering increased and the amount of Mn contributing to enhancing the strength decreased. Furthermore, since manganese oxide has an oxidizing effect and adversely affects the respective components of the composition iron powder, the tensile strength was 550 MPa and did not reach the target strength, 580 MPa. In No. 30, the Mn content in the Fe—Mn powder was low, i.e., 50%. Thus, the hardness of the Fe—Mn powder increased, the density of the compact decreased, and the tensile strength was 505 MPa and did not reach the target strength, 580 MPa. As such, none of the composition iron powders outside the composition ranges of the present invention reached the target strength, i.e., 580 MPa achieved in Examples, and exhibited enhanced strength.

Figure 2:
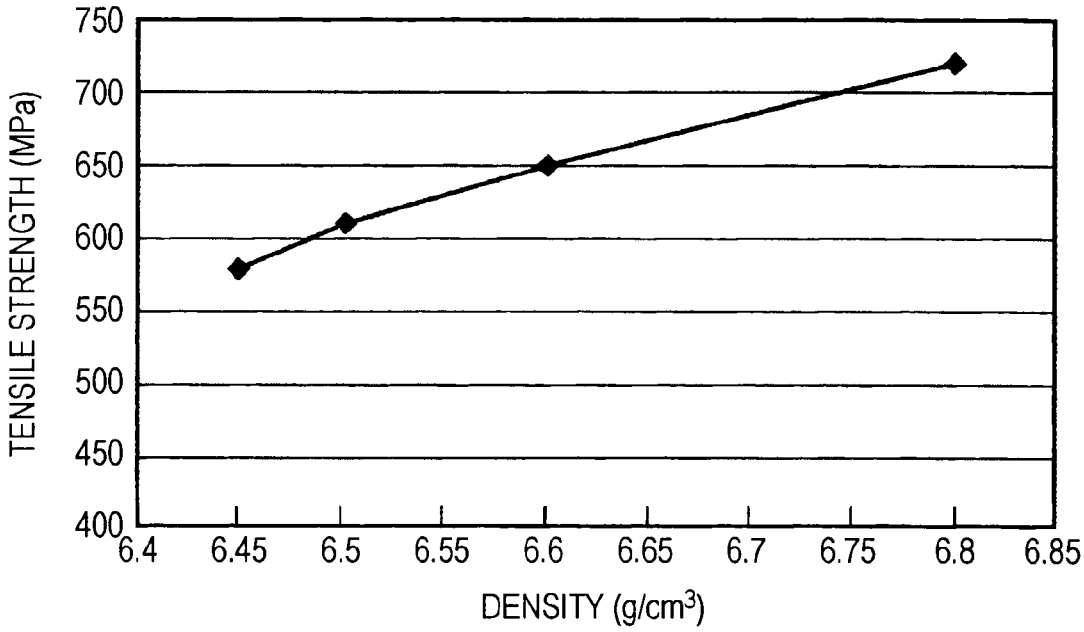
FIG. 2 is a graph showing the relationship between the density and the tensile strength when prealloyed steel powders are used as an iron base powder.
Figure 3:
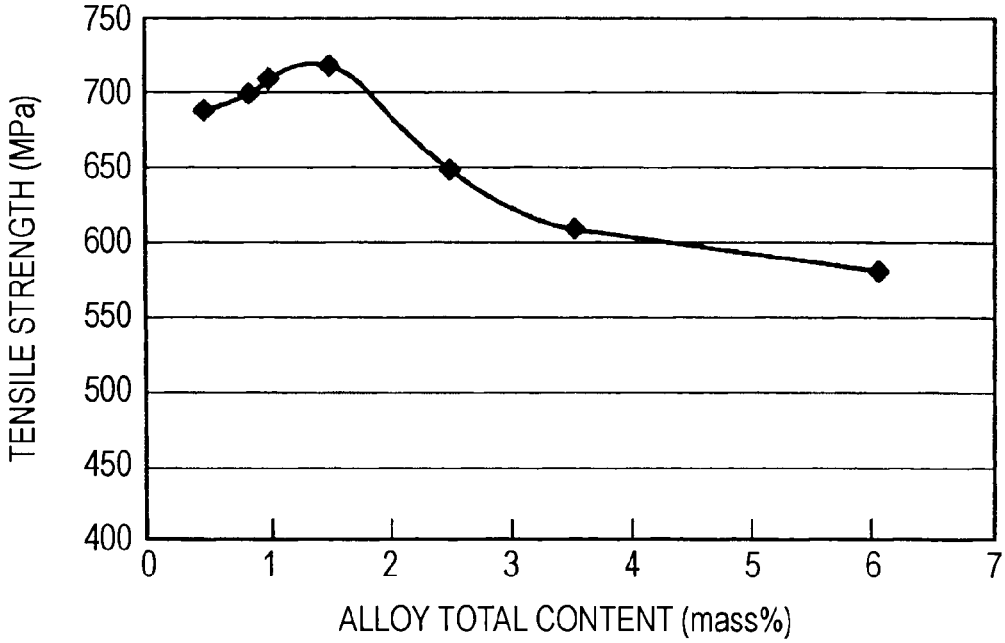
FIG. 3 is a graph showing the relationship between the total content of the alloying elements and the tensile strength when prealloyed steel powders are used as an iron base powder.

FIGS. 2 and 3 are graphs respectively showing the relationship between the density and the tensile strength and the relationship between the alloy total content and the tensile strength determined by conducting density measurement and tensile testing. Samples were prepared by adding 1.3 mass % of an Fe—Mn powder (22% Fe-78% Mn, particle diameter: 15 μm), 3 mass % of a Cu powder (D50: 75 μm), 0.8 mass % of a graphite powder (D50: 15 μm), and 0.8 mass % of zinc stearate to a prealloyed-type steel powder having a composition shown in Table 4 serving as an iron base powder, mixing the resulting mixture for 30 minutes in a V-type mixer, forming the resulting mixture into a tensile test piece shown in FIG. 1 under a pressure of 5 ton/cm$^2$ (490 MPa), and sintering the test piece for 20 minutes in a nitrogen atmosphere at 1120° C. FIG. 2 (Nos. 4 to 7 in Table 4) shows that a good correlation is found between the density of the press-formed compact and the strength. FIG. 3 (Nos. 1 to 7 in Table 4) shows that although the tensile strength increases with the alloy total content, the tensile strength decreases as the alloy total content exceeds 1.5 mass %. At around an alloy total content of 2 mass %, a tendency of exhibiting a tensile strength of 690 MPa, which is equal to that observed at an alloy total content of 0.5 mass %, is observed. This shows that the strength does not increase by adding a total of more than 2 mass % of alloying elements. FIG. 2 shows that this is attributable to the decreased density of the press-formed compact.

TABLE 4

| | Alloy components (mass %) | | | Alloy total content | Tensile strength | Density |
|---|---|---|---|---|---|---|
| No. | Ni | Mo | Cu | (mass %) | (MPa) | (g/cm$^3$) |
| 1 | 0.5 | 0.5 | | 1.0 | 710 | |
| 2 | | 0.5 | | 0.5 | 690 | |
| 3 | | 0.85 | | 0.85 | 700 | |
| 4 | | 1.5 | | 1.5 | 720 | 6.8 |
| 5 | 2 | 0.5 | | 2.5 | 650 | 6.6 |
| 6 | 3 | 0.5 | | 3.5 | 610 | 6.5 |
| 7 | 4 | 0.5 | 1.5 | 6.0 | 580 | 6.45 |

In addition to Examples Nos. 1 to 16, Example No. 31 was prepared as shown in Table 4 and FIGS. 2 and 3 by using a prealloyed steel powder having an Mo content of 1.5 mass % was used as the iron base powder. In No. 31 having an alloying element content in the iron base powder of 2 mass % or less, the strength increased to 720 MPa from 690 MPa observed in No. 15 having a Mo content of 0.5 mass %, and the density of the compact also increased to 6.8 g/cm$^3$, which was higher than the case in which the 4% Ni-1.5% Cu-0.5% Mo diffusion-alloyed steel powder was used. In Comparative Example No. 32 (2% Ni-0.5% Mo, 2.5 mass % in total) in which the alloying element content exceeds 2 mass %, the strength was 650 MPa and the density was 6.6 g/cm$^3$, i.e., lower than Example No. 31. In Comparative Example 33 (3% Ni-0.5% Mo, 3.5 mass % in total), the strength further decreased to 610 MPa and the density further decreased to 6.5 g/cm$^3$. This is because as the alloying element content in the iron base powder increases, the iron base powder becomes harder and the density does not readily increase during forming, as described above. In particular, when the alloy content exceeds 2 mass %, the strength and density decrease notably upon forming. Furthermore, since the iron base powder is hard, the lifetime of the forming die is shortend, resulting in an increase in cost.

What is claimed is:

1. An iron powder comprising:

an iron base powder;

0.5 to 3.0 mass % of an Fe—Mn powder having a particle diameter of 45 μm or less and a Mn content in the range of 60 to 90 mass %;

1.0 to 3.0 mass % of a Cu powder; and 0.3 to 1.0 mass % of a graphite powder, wherein the mass ratio of the amount of Mn contained in the Fe—Mn powder to the amount of the Cu powder is in the range of 0.1 to 1.

2. The iron powder according to claim 1, further comprising:

0.4 to 1.2 mass % of a powder lubricant for die-forming.

3. The iron powder according to claim 1, wherein the iron base powder is a pure iron-type iron powder having a purity of 98% or higher.

4. The iron powder according to claim 1, wherein the iron base powder contains at least one alloying element selected from the group consisting of Ni, Mo, Cr, and Mn, and the total content of the at least one alloying element is in the range of 0.3 to 2.0 mass %.

5. The iron powder according to claim 1, further comprising 0.1 to 0.8 mass % of a machinability-improving powder.

6. A high-strength sintered part produced by press-forming the iron powder of claim 1 and sintering the press-formed iron powder, wherein the sintering is performed in the temperature range of the melting point of Cu to 1300° C.

* * * * *